US008622394B2

(12) United States Patent
Larue

(10) Patent No.: US 8,622,394 B2
(45) Date of Patent: Jan. 7, 2014

(54) FREE-STANDING ACTION TARGET MECHANISM FOR FIREARM TRAINING

(76) Inventor: Mark C. Larue, Leander, TX (US)

( * ) Notice: Subject to any disclaimer, the term of this patent is extended or adjusted under 35 U.S.C. 154(b) by 211 days.

(21) Appl. No.: 13/317,890

(22) Filed: Oct. 31, 2011

(65) Prior Publication Data

US 2013/0106059 A1 May 2, 2013

(51) Int. Cl.
*F41J 1/10* (2006.01)

(52) U.S. Cl.
USPC ..... 273/407

(58) Field of Classification Search
USPC ..... 273/403–410, 390–392; 248/122.1, 248/123.11, 125.1, 246
See application file for complete search history.

(56) References Cited

U.S. PATENT DOCUMENTS 2,372,111 A * 3/1945 Norberg ..... 273/407
3,638,894 A * 2/1972 Leutenegger ..... 248/230.1
2003/0168813 A1* 9/2003 Wilkus ..... 273/407
2010/0225063 A1* 9/2010 Wyrick et al. ..... 273/390
2011/0062668 A1* 3/2011 Leimberer ..... 273/407

* cited by examiner

*Primary Examiner* — Mark Graham
(74) *Attorney, Agent, or Firm* — James L. Jackson

(57) ABSTRACT

A free-standing post supported target mechanism has a support post of a defined cross-sectional geometry. A baseplate defines a post opening receiving the support post and has a first orientation permitting movement of the baseplate along the length of the support post and a second orientation establishing a gripping relation with the support post. A spall plate defines a post opening receiving the support post and has a first orientation permitting movement of the spall plate along the length of the support post and a second orientation establishing a gripping relation of the spall plate with the support post. A target plate engages the baseplate and the spall plate and is secured by a locking member. A target base defines a receptacle receiving and supporting the support post and establishes a weight-forward condition that offsets the rearward forces of bullet impact.

17 Claims, 4 Drawing Sheets

FREE-STANDING ACTION TARGET MECHANISM FOR FIREARM TRAINING

BACKGROUND OF THE INVENTION

1. Field of the Invention

The present invention relates generally to target devices that are employed by firearm users for the purpose of marksmanship training and practice, for general shooting activities and for sighting in the various types of sighting devices that are mounted on firearms. More particularly, the present invention concerns a portable free-standing target mechanism that presents a silhouette or other type of target on a bullet resistant panel that enables a firearm user to determine when the target has been struck, thus verifying the accuracy of firearm sighting and shooting activities. Even more specifically, the present invention concerns a portable target mechanism that can be set up or taken down in a short period of time and requires little or no preparation of the site, except for the choice of a site having a backdrop that is capable of stopping any bullets that should miss the target.

2. Description of the Prior Art

Regardless whether a firearm is to be used for tactical shooting activities by military or police personnel, is to be used for hunting or sporting shooting activities or is intended to be used for training by competitive marksmen, there is virtually always a need for shooting bullets at targets. Targets can be provided at permanent shooting ranges and can be fixed or can be moveable from a retracted non-exposed position to an exposed position where the target can be seen by a shooter. The target can be of the silhouette type, typically representing the body or torso of a human, or the body of an animal, or can be in the form of a panel that is provided with a replaceable paper target that is printed with target indicia in the form of circles, squares or other desired shapes. Portable firearm targets are also frequently provided, which can be set up for shooting activities in a short period of time; however these types of target devices or mechanisms are typically lacking from the standpoint of durability and are often damaged and rendered useless during firearm shooting activities.

Silhouette targets, whether permanently installed or of portable nature typically employ a bullet resistant panel that is composed of a durable material, such as steel plate, that can reflect a bullet or its components back along its trajectory when struck, thus presenting considerable hazard to the user of the firearm. Steel plate material has an inherent spring-like characteristic, and when struck by a bullet, the spring characteristic of the target plate, resulting from the preloading energy of a bullet strike, can propel the bullet directly back to the shooter. Therefore, it is desirable to provide a plate-like target that is supported in predetermined angulated orientation that directs a reflected bullet into the ground or away from the shooter. It is also desirable to provide a target mechanism having a bullet resistant metal panel and also having the capability for catching or redirecting a reflected bullet and preventing its reflected flight in any direction away from the target plate of a target mechanism.

SUMMARY OF THE INVENTION

It is a primary feature of the present invention to provide a novel free-standing target mechanism having a bullet resistant target plate and having a support structure that is adapted for receiving a wood or other type of post for support and positioning of the target mechanism;

It is another feature of the present invention to provide a novel free-standing target mechanism that supports a bullet resistant target plate in angulated position for directing reflected bullets and bullet components safely away from the firearm user; and It is also a feature of the present invention to provide a novel free-standing target mechanism having a bullet-resistant target plate and further incorporating a spall member that is also bullet-resistant and serves to essentially catch reflected bullets and bullet components and prevent them from being reflected and potentially representing a hazard to the shooter or any other personnel or equipment that may be situated in the vicinity of the shooting activity.

Briefly, the various objects and features of the present invention are realized by a portable, free-standing target mechanism having a base structure that efficiently supports the target mechanism on the ground or on any other essentially flat surface. The base structure defines a receptacle within which is received the lower end of a support post that can be composed of wood, metal or any of a number of suitable polymer materials. The post base includes a pair of angulated forwardly-projecting leg members that compensate for the weight of a target plate and its plate support structure.

A target positioning member, which can be composed of plate material, such as bullet resistant steel, such as "rifle steel", defines an opening that is of a dimension permitting the target positioning member, when oriented at a first predetermined position, to be received in moveable relation along the length of the support post and when oriented at a second predetermined position, to establish a binding and gripping relation with the support post. The first predetermined position may be described as "substantially level" and the second predetermined position may be described as "angulated" or inclined with respect to the horizontal. The target support member also defines an upwardly-projecting portion which is disposed in angulated relation with a body portion of the support member and serves to catch or redirect any reflected bullets and bullet fragments and ensure that the bullets are rendered safe.

A spall unit incorporates a spall support structure which defines a rectangular shaped opening and also receives the support post and has a first position establishing a moveable relation with the support post and a second position establishing a gripping or binding relation with the support post. The spall assembly is preferably composed of bullet resistant steel plate material, such as AR500 hard armor plate steel, having a hardness of 500 Brinell and commonly referred to as "rifle steel". The spall assembly may be composed of any other suitable bullet resistant material, and serves to resist the damage that could otherwise be caused by bullet strikes during target shooting activity.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments without departing from the spirit and scope of the present invention.

In the Drawings:

FIG. 1 is an isometric illustration of a target assembly, representing the preferred embodiment of the present invention, and showing a support base and spall unit and having a support post supporting and positioning the spall unit above the support base;

FIG. 2 is an exploded isometric illustration showing the components of the target mechanism of the FIG. 1;

Figure 3:
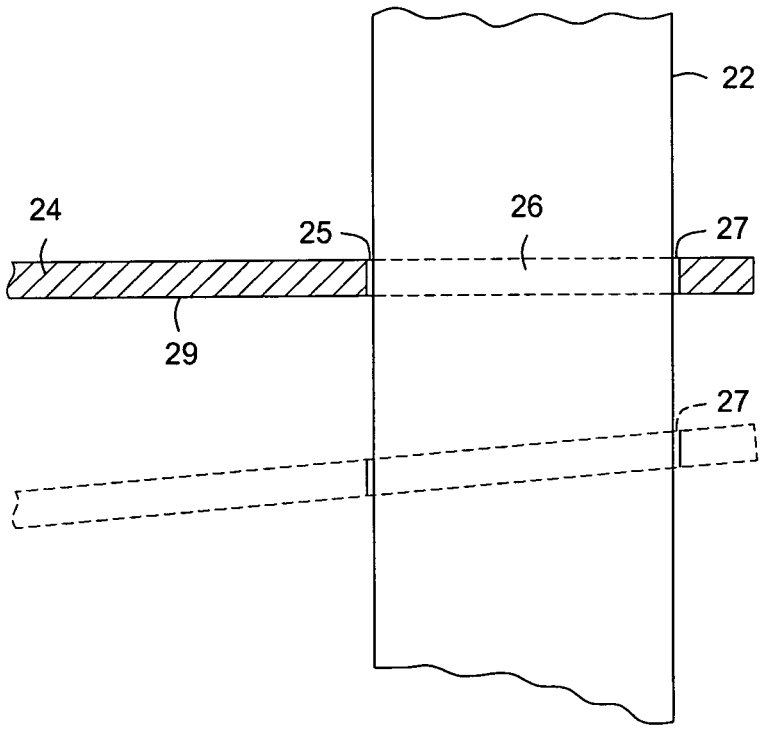
Figure 4:
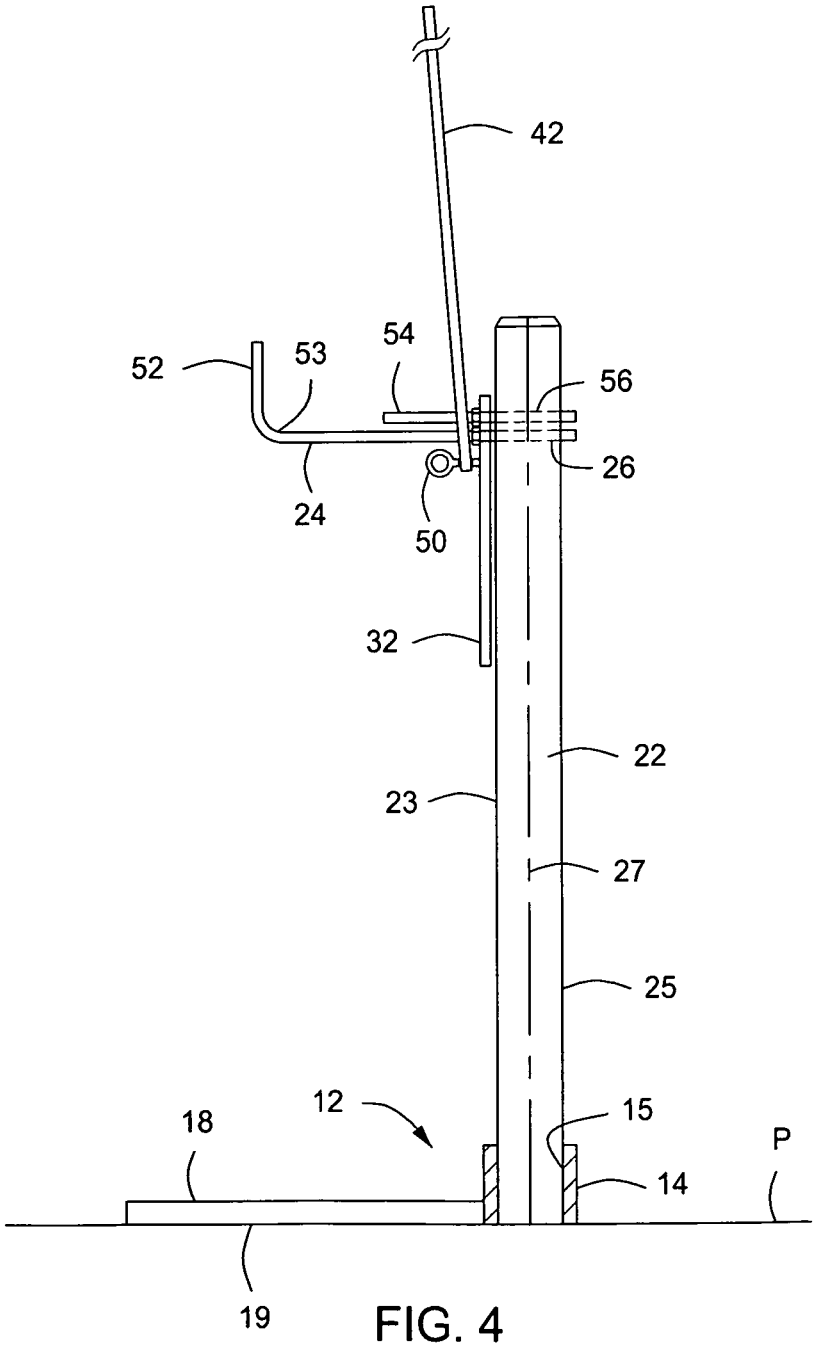

FIG. 3 is a side view of the upper portion of the support post and shows a portion of the base plate structure, illustrating in full line the moveable relation of the base plate structure with the support post and illustrating in broken line, the binding and immoveable relation of the base plate structure with the support post; and FIG. 4 is a side elevation view showing the assembled condition of the post supported target apparatus of the present invention, and illustrating the relative positions of the components thereof in detail.

DETAILED DESCRIPTION OF PREFERRED EMBODIMENT

Figure 1:
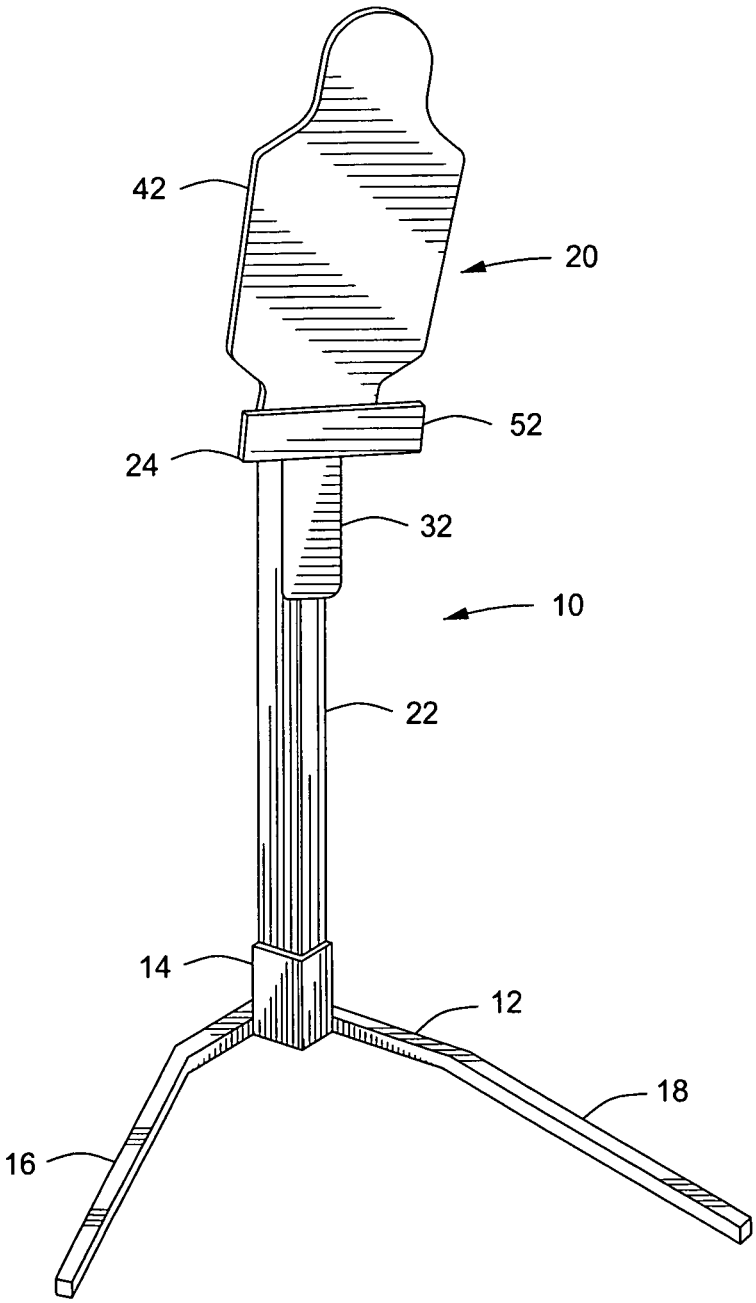
Figure 2:
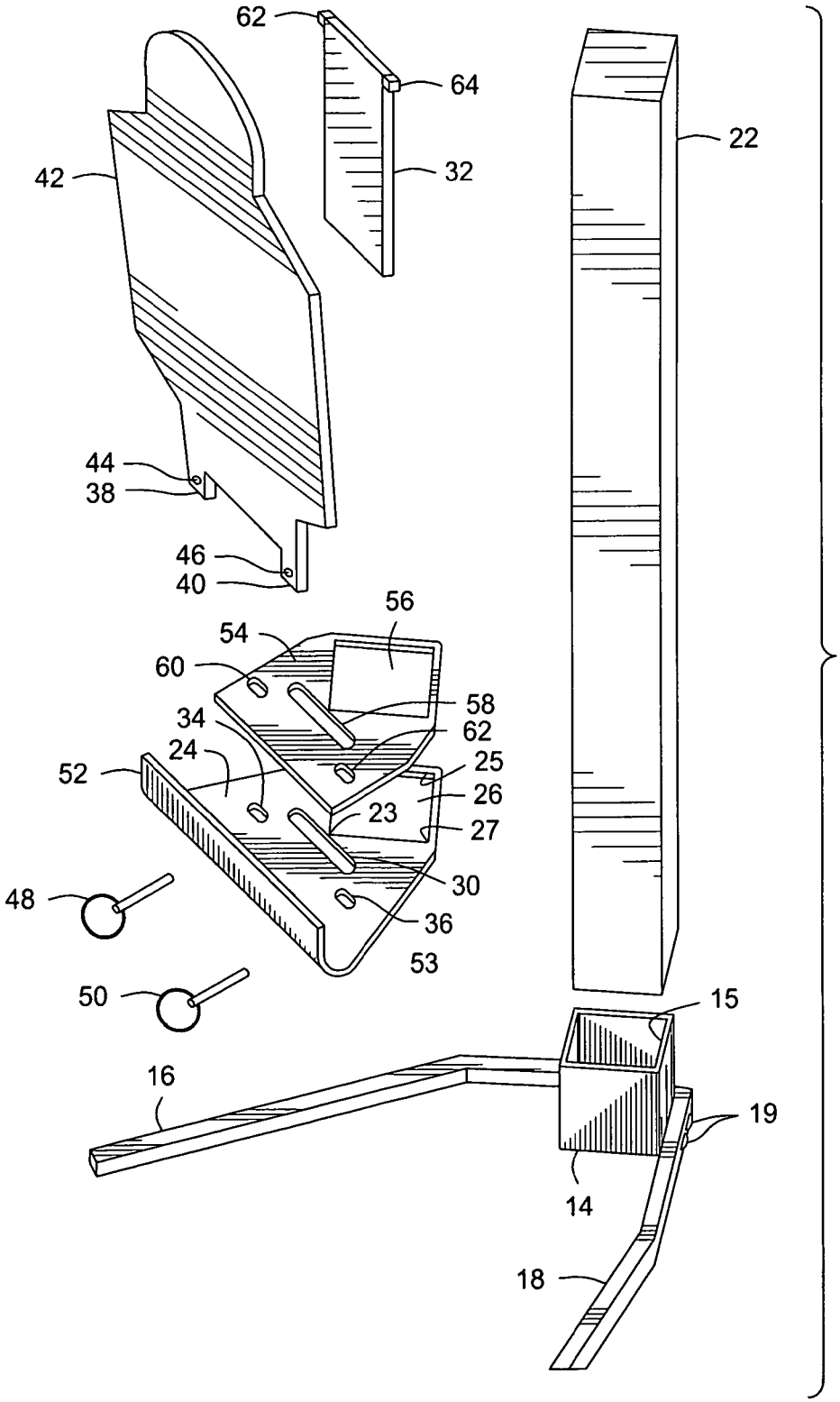

Referring now to the drawings and first to FIGS. 1 and 2, a target mechanism embodying the principles of the present invention is shown generally at 10 and incorporates a support base assembly, shown generally at 12, and having a post support member 14 of tubular form that defines a post support receptacle 15. The post support receptacle may be open completely through or, if desired, may be closed by a lower closure plate or panel. The post support receptacle 15 preferably has a generally rectangular or square cross-sectional configuration, corresponding to the cross-sectional configuration of a 4"×4" wood post 22, or may have any other tubular form, such as cylindrical, octagonal, triangular, etc., as desired. To the lower end portion of the post support member 14 is mounted a pair of support legs 16 and 18 that extend laterally and forwardly from the post support member.

Each of the support legs is preferably an independent leg member that is mounted to the post support member 14 by means of bolts or any other suitable fasteners 19, as shown in the exploded isometric illustration of FIG. 2. Bolted mounting of the support leg members permits the leg members to be removed, if desired, so that the target unit can be easily stored, and can be quickly and efficiently assembled via the use of a simple wrench. When in assembly with the post support member 14, the lower surfaces 19 of the forwardly and laterally extending leg members are substantially coincident with an imaginary plane "P" to which the lower end of the post support member 14 is also coincident. If desired, however, the support legs 16 and 18 may be defined by an integral leg unit having its centermost portion essentially wrapped around the lower rear portion of the post support member 14 and being bolted, welded or otherwise fixed to the lower end portion of the post support member as desired. The forwardly and laterally extending support legs 16 and 18, in addition to providing supporting stability for the target support post 22, also provide a weight-forward characteristic, adding to the forwardly acting characteristic of a target and spall unit, shown generally at 20 and permitting the target support post member 22 to be oriented substantially vertically when the target mechanism is in position for shooting activity. It should be borne in mind that the term "weight-forward" is intended to mean that the target apparatus and its support apparatus establish a greater weight that is oriented in a forward direction, toward the point from which bullets are fired to strike the target assembly. Because of this weight-forward characteristic, the force of a bullet strike on the target is offset by the weight-forward condition and will resist the tendency of a bullet force to cause the target assembly to fall over backwards.

While the post support member 14 is shown to have a rectangular, i.e., square, cross-sectional configuration, so as to receive the rectangular target support post 22, which preferably is a square 4"×4" wood post, it is not intended to limit the spirit and scope of the present invention to this particular geometric form or material. The support post and the target support member may have rectangular cross-section or to restrict the present invention to use with square posts or posts constructed of wood. The support post 22 may have any of a wide variety of cross-sectional configurations, such as circular, triangular, octagonal, etc., as mentioned above, and the post support member 14 and its post support receptacle 15 may have a corresponding geometric configuration without departing from the spirit and scope of this invention.

Likewise, the support leg members 16 and 18 may be of rectangular configuration as shown, such as being composed of solid metal bar material, such as steel bar stock, or may have any of a number of other cross-sectional configurations, such as circular, triangular, octagonal, etc. as desired. The support leg members may be solid or of tubular form, if desired, it only being necessary that they be of sufficient structural integrity and weight for efficiently and adequately supporting the target mechanism and resistance to the forces of bullet strikes. Preferably, the support leg members 16 and 18 will be composed of solid bar stock, so as to enhance the weight-forward characteristics of the free-standing target assembly.

It should be borne in mind that the free-standing target assembly will be designed according to a particular range of bullets and cartridges. While a free-standing target assembly of the present invention may be efficiently utilized for a class of cartridges, such as 5.56, 7.62, 300 Win Mag and 338 Lapua, larger and more powerful cartridges, such as the 0.50 BMG will likely cause damage to some components of the target mechanism. For these more powerful cartridges, the target mechanism will need to be designed to accommodate the larger forces of 50 BMG and the like. Also, to prevent accelerated wear of target components, the distance of the target assembly from the point of shooting should be controlled according to the energy characteristics of particular cartridges.

The spall unit 20 includes a base plate structure 24 that is composed of bullet-resistant material, such as AR500 hard armor plate steel, having a hardness of 500 Brinell and commonly referred to as "rifle steel", and defines a post opening 26 having an internal geometry corresponding to the geometry of the target support post 22 as is evident in FIGS. 2, 3 and 4. In the drawings the target support post 22 is shown to have a square cross-sectional configuration, thus the post opening 26 also defines a square internal geometry. The support post opening 26 is sufficiently large that the base plate structure will slide or can be easily moved along the length of the target support post, when the base plate structure is oriented in essentially normal relation with the post as shown in full line in FIG. 3. When the base plate structure 24 is oriented in inclined relation with respect to the horizontal, as shown in broken line in FIG. 3, the base plate structure will establish a gripping or binding relation with the support post, preventing further movement of the base plate structure relative to the target support post. This post gripping or binding relation is enhanced by the rather sharp corners 25 and 27 that are defined by the intersection of the post opening 26 with the upper and lower surfaces 28 and 29 of the base plate structure 24. These sharp corners tend to bite into the wood material of the support post, or establish a binding effect, if the post is composed of metal material or a polymer material. The post opening 26 and the post receptacle 15 of the post base member 14 are oriented so that a corner of the post base member and target support post 22 is positioned to face forwardly, i.e., toward the point from which the shooter will fire bullets at the target.

As further shown in the exploded isometric illustration of FIG. 2, the base plate structure 24 defines an elongate slot 30 for receiving a post protector plate 32 and a pair of spaced elongate receptacle openings 34 and 36 for receiving spaced downwardly projecting connecting tabs 38 and 40 of a target plate 42. The spaced downwardly projecting connecting tabs 38 and 40 of the target plate 42 each define through holes 44 and 46 through which locking pins 48 and 50 extend, to secure the connecting tabs 38 and 40 within the receptacle openings 34 and 36. The baseplate structure 24 also defines an upwardly projecting bullet reflection flange 52, which is shown in FIGS. 2 and 4. The bullet reflection flange may be formed by simply bending a lower portion of the bullet resistant plate material of the baseplate 24 so that, with the baseplate at its downwardly and forwardly inclined position, the bullet reflection flange will be oriented in an upward angulated and forwardly projecting position. This feature ensures that bullets and bullet fragments will be directed downwardly from the target plate and will essentially be caught in the angular region 53 that is defined by intersection of the bullet reflection flange 52 with the baseplate 24. The upwardly projecting bullet reflection flange 52 may also be welded, bolted or otherwise attached to the base plate member 24 if desired.

A spall plate member 54, also composed of bullet resistant material, defines a post opening 56 having the configuration of the support post member 22 and serving to establish moveable or binding relationships with the support post member depending on its position with respect to the support in similar manner as discussed above in connection with the support plate structure 24. The spall plate member 54 also defines an elongate slot 58 and spaced through holes 60 and 62 which have the same purpose as described above concerning the elongate slot 36 and the space through holes 34 and 36 of the base plate structure.

The post openings of the baseplate and spall plate are preferably of square configuration and define four corners, as shown in FIG. 2. One of these corners of each of the baseplate and spall plate is designated as the front or forward corner 23 and is oriented to face the point from which the shooter fires bullets at the target. Another of these corners is designated as the rear or back corner 25 and is oriented to face away from the shooting point. Two of the corners are designated as side corners 27 and are oriented substantially perpendicular to a line passing through the front and rear corners 23 and 25.

With the base plate 24 and the spall plate 54 properly spaced and positioned relative to the support post 22, the downwardly projecting connection tabs 38 and 40 will project through both sets of elongate slots 60-62 and 34-36 so that the through holes 44 and 46 will be positioned below the baseplate. The locking pins 48 and 50 are extended through the through holes and the locking rings thereof are pivoted to the locked positions. The post protector plate 32 extends through the aligned elongate slots 58 and 30 of the spall plate 54 and the base plate structure 24 and extends downwardly along the upper front portion of the target support post and protects an upper portion of the target support post from the damaging effects of errant bullet strikes. The post protector plate 32 defines a pair of laterally extending positioning tabs 62 and 64, which engage the upper surface of the spall plate member 54 adjacent the spaced elongate openings 60 and 62, and serve as stop members to prevent further downward movement of the post protector plate 32 relative to the spall plate 54. If desired, the post protector plate may be eliminated from the target assembly, since it is not necessary for positioning of the target plate member 42. However, its use is desirable, since bullet strikes below the target plate, which often happen, will not damage the upper portion of the target support post 22

The post openings 26 and 56 of the base plate 24 and spall plate 54 permit the base plate and the spall plate to be positioned at any desired elevation along the length of the support post 22 so that the elevation of the target plate 42 may be easily adjusted a desired elevation that suits the needs of the shooter.

Assembly and Operation

Assuming the target support base 12 is intended to be positioned on the ground or on any other relatively flat surface, shown at "P" in FIG. 4, the support leg members 16 and 18 will be attached to the post receptacle 15 by installing and tightening the leg support bolts 19. When the target support base 12 is in the desired position, with the front corner of the post support member 14 facing the shooting point, the lower end portion of a support post member 22 will be inserted into the post support receptacle 15. As an alternative, assuming a more permanent target installation is intended, the support post 22 can be installed by securing it within a post hole in the soil. The soil surrounding the support post 22 will then be tamped so as to adequately secure the post within the post hole. As a further alternative, the post may simply be concreted within a post hole.

With the support post 22 positioned substantially vertically by the target support base 12 or by any other suitable means, the baseplate and the spall plate will be positioned with rectangular openings 56 and 26 positioned to permit movement of the support post therethrough. To permit positioning movement of the baseplate and spall plate downwardly along a desired length of the target support post 22, these plates will be oriented with the plate structures located generally horizontally, and thus substantially perpendicularly with the target support post. When the desired positions of the base plate and spall plate have been achieved, these plate members will be shifted from a horizontal orientation to an angular orientation, causing the rather sharp edges of the plate openings to establish a binding or locking relation with respect to the support post 22, thus essentially locking the plates against further downward movement relative to the support post. At this point, the elongate through holes 60 and 62 of the spall plate will be positioned in aligned registry with the through holes 34 and 36 of the base plate.

The target plate member 42 will then be lowered and its downwardly projecting connection tabs 38 and 40 will be extended through the aligned elongate through holes so that the locking pin holes 44 and 46 of the connection tabs will be located below the lower surface of the base plate 24. The locking pins 48 and 50 will then be inserted through the locking pin holes and the locking rings of the locking pins will be moved to the locked positions thereof. While the target mechanism may be effectively used in this assembled condition, the upper portion of the support post 22 can be struck and damaged by stray bullets. In a fairly short time the support post will need replacement due to the damage that is caused by bullet strikes. To prolong the service life of the support post, the post protector plate 32 can be inserted downwardly through the aligned elongate slots 58 and 30 of the spall plate and base plate to the point that the lateral positioning tabs 62 and 64 establish positioning engagement with the upper surface of the spall plate 54. At this position a major portion of the post protector plate will extend downwardly, below the baseplate 24, and will be positioned in front of the target support post, thus protecting the upper portion of the support post 22 from damage by bullet strikes.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. Therefore, the present embodiment is to be considered as merely illustrative and not restrictive, the scope of the invention being indicated by the claims rather than the foregoing description, and all changes which come within the meaning and range of equivalence of the claims are therefore intended to be embraced therein.

I claim:

1. A free-standing post supported target mechanism, comprising:

a target support post having a defined cross-sectional geometry;

a baseplate structure having a post opening receiving said support post and having a first orientation permitting movement of said baseplate structure along the length of said support post and a second orientation establishing substantially immoveable gripping relation of said baseplate with said support post, said baseplate defining a rear portion defining said post opening thereof and having a front portion oriented toward a firing position from which bullets are fired toward said free-standing post supported target mechanism;

a bullet deflection flange member projecting laterally and upwardly from said baseplate and defining a bullet and bullet component deflector minimizing reflection of bullets and bullet components toward the firing position;

a spall plate structure defining a post opening receiving said support post and having a first orientation permitting movement of said spall plate structure along the length of said support post and a second orientation establishing substantially immoveable gripping relation of said spall plate with said support post;

a target plate having locking engagement with said baseplate structure and with said spall plate structure; and a locking member establishing locking of said target plate to said baseplate and spall plate.

2. The free-standing post supported target mechanism of claim 1, comprising:

said baseplate and said spall plate each defining spaced openings;

said target plate having downwardly extending projections extending through said spaced openings; and said locking member engaging one of said downwardly extending projections and securing said downwardly extending projection within said spaced openings.

3. The free-standing post supported target mechanism of claim 1, comprising:

said baseplate and said spall plate each defining a pair of spaced openings being disposed in aligned registry;

said target plate having a pair of downwardly extending projections extending through said spaced openings and defining locking pin openings; and said locking member being a pair of locking pins each engaging within one of said locking pin openings of said downwardly extending projections and securing said downwardly extending projections within said spaced openings of said downwardly extending projections.

4. The free-standing post supported target mechanism of claim 1, comprising:

said defined cross-sectional geometry of said target support post being generally square; and having a corner thereof oriented toward a direction from which bullets are fired at said post supported target mechanism;

said post openings of said baseplate and said spall plate each being of substantially square configuration and receiving said target support post therein and when oriented in substantially normal relation with said target support post being moveable along the length of said target support post and when oriented in inclined relation with said target support post establishing a binding and substantially immoveable relation with said target support post; and a target support base having a receptacle receiving and supporting the lower end of said support post.

5. The free-standing post supported target mechanism of claim 4, comprising:

said corner of said target support post being a front corner, said target post also having a rear corner facing away from the direction from which bullets are fired at said target plate; and said pair of spaced openings of said baseplate and said spall plate each having a corner facing the direction from which bullets are fired at said target plate and establishing a combined weight that is greater at said front corner of said target support post and establishes a weight-forward target condition that permits bullet strike absorption and minimizes the potential that the target will be forced to fall over backwards by the force of bullet strikes.

6. The free-standing post supported target mechanism of claim 5, comprising:

a support base having a post support receptacle receiving and supporting said target support post; and support leg members projecting forwardly and laterally from said post support receptacle and enhancing said weight-forward target condition of sais post supported target mechanism.

7. The free-standing post supported target mechanism of claim 6, comprising:

fastener members securing said support leg members to said post support receptacle.

8. The free-standing post supported target mechanism of claim 6, comprising:

said post support receptacle having a generally rectangular cross-sectional configuration corresponding to the configuration and orientation of said target support post.

9. The free-standing post supported target mechanism of claim 1, comprising:

said target support post being of substantially square cross-sectional configuration and defining a corner oriented forwardly toward the direction from which bullets are fired at said target mechanism;

said baseplate and said spall plate each defining elongate slots disposed in aligned registry; and a post protector plate extending through said elongate slots and extending downwardly below said baseplate along said forwardly oriented corner of said target support post.

10. A free-standing post supported target mechanism, comprising:

a target support post having a generally rectangular cross-sectional configuration and defining a forward corner disposed in facing relation with the direction from which bullets are fired at said target;

a baseplate structure having a generally rectangular post opening receiving said support post and having a first orientation permitting movement of said baseplate structure along the length of said support post and a second orientation establishing substantially immoveable gripping relation of said baseplate with said support post, said baseplate defining a rear portion defining said post opening thereof and having a front portion oriented toward a firing position from which bullets are fired toward said free-standing post supported target mechanism;

a bullet deflection flange member projecting laterally and upwardly from said baseplate and defining a bullet and bullet component deflector minimizing reflection of bullets and bullet components toward the firing position;

a spall plate structure defining a generally rectangular post opening receiving said support post and having a first orientation permitting movement of said spall plate structure along the length of said support post and a second orientation establishing substantially immoveable gripping relation of said spall plate with said support post;

a target plate having locking engagement with said baseplate structure and said spall plate structure and being oriented to establish a weight-forward target condition that resists target knock down by the energy of bullet strikes on said target plate;

a locking member establishing locking of said target plate to said baseplate and spall plate;

a support base having a post support receptacle receiving and supporting said target support post; and support leg members projecting forwardly and laterally from said post support receptacle and enhancing said weight-forward target condition of sais post supported target mechanism.

11. The free-standing post supported target mechanism of claim 10, comprising:

said corner of said target support post being a front corner, said target post also having a rear corner facing away from the direction from which bullets are fired at said target plate; and said pair of spaced openings of said baseplate and said spall plate each having a corner facing the direction from which bullets are fired at said target plate and establishing a combined weight that is greater at said front corner of said target support post and establishes a weight-forward target condition that permits bullet strike absorption and minimizes the potential that the target will be forced to fall over backwards by the force of bullet strikes.

12. The free-standing post supported target mechanism of claim 10, comprising:

said generally rectangular cross-section of said target support post being a square cross-sectional configuration;

said post receptacle of said support base being of square cross-sectional configuration and receiving and supporting said square target support post; and support leg members projecting forwardly and laterally from said post support receptacle and enhancing said weight-forward target condition of sais post supported target mechanism; and fastener members securing said support leg members to said post support receptacle.

13. The free-standing post supported target mechanism of claim 10, comprising:

said target support post being of substantially square cross-sectional configuration and defining a corner oriented forwardly toward the direction from which bullets are fired at said target mechanism;

said baseplate and said spall plate each defining elongate slots disposed in aligned registry; and a post protector plate extending through said elongate slots and extending downwardly below said baseplate along said forwardly oriented corner of said target support post.

14. The free-standing post supported target mechanism of claim 10, comprising:

said baseplate and said spall plate each defining spaced openings;

said target plate having downwardly extending projections extending through said spaced openings; and said locking member engaging one of said downwardly extending projections and securing said downwardly extending projection within said spaced openings.

15. The free-standing post supported target mechanism of claim 10, comprising:

said baseplate and said spall plate each defining a pair of spaced openings being disposed in aligned registry;

said target plate having a pair of downwardly extending projections extending through said spaced openings and defining locking pin openings;

said locking member being a pair of locking pins each engaging within one of said locking pin openings of said downwardly extending projections and securing said downwardly extending projections within said spaced openings of said downwardly extending projections;

said baseplate and said spall plate each defining elongate slots disposed in aligned registry; and a post protector plate extending through said elongate slots and extending downwardly below said baseplate along said forwardly oriented corner of said target support post.

16. A free-standing post supported target mechanism, comprising:

a target support post having a square cross-sectional configuration and defining a forward corner disposed in facing relation with the direction from which bullets are fired at said target;

a baseplate structure having a rear portion defining a square post opening having gripping edges receiving said support post and having a first orientation normal with said support post and permitting movement of said baseplate structure along the length of said support post and a second orientation in angular relation with said support post with said gripping edges establishing substantially immoveable gripping relation of said baseplate with said support post;

said baseplate defining a front portion oriented toward a firing position from which bullets are fired toward said free-standing post supported target mechanism; and a bullet deflection flange member projecting laterally and upwardly from said baseplate and defining a bullet and bullet component deflector minimizing reflection of bullets and bullet components toward the firing position;

a spall plate structure defining a generally square post opening receiving said support post and having a first orientation permitting movement of said spall plate structure along the length of said support post and a second orientation establishing substantially immoveable gripping relation of said spall plate with said support post;

said square post openings of said baseplate structure and said spall plate each defining a corner disposed in facing relation with the direction from which bullets are fired at said post supported target mechanism;

a target plate having locking engagement with said baseplate structure and said spall plate structure;

a locking member establishing locking of said target plate to said baseplate and spall plate;

a support base having a post support receptacle receiving and supporting said target support post;

said baseplate structure, said spall plate and support leg members each being located near said forward corner of said support post and establishing a weight-forward target condition that resists target knock down by the energy of bullet strikes on said target plate said support leg members projecting forwardly and laterally from said post support receptacle and enhancing said weight-forward target condition of said post supported target mechanism.

17. The free-standing post supported target mechanism of claim 16, comprising:

said baseplate and said spall plate each defining elongate slots disposed in aligned registry; and a post protector plate extending through said elongate slots and extending downwardly below said baseplate along said forwardly oriented corner of said target support post and protecting an upper portion of said target support post from damage by stray bullet strikes.

* * * * *